US012751545B2

(12) United States Patent
Fundberg et al.

(10) Patent No.: US 12,751,545 B2
(45) Date of Patent: Oct. 6, 2026

(54) DEVICE FOR ATTACHING A LEG TO A PANEL OF A CABINET

(71) Applicant: Inter IKEA Systems B.V., Ln Delft (NL)

(72) Inventors: Oskar Fundberg, Älmhult (SE); Anders Oskarsson, Älmhult (SE)

(73) Assignee: Inter IKEA Systems B.V., Delft (NL)

( * ) Notice: Subject to any disclaimer, the term of this patent is extended or adjusted under 35 U.S.C. 154(b) by 48 days.

(21) Appl. No.: 18/864,160

(22) PCT Filed: May 11, 2023

(86) PCT No.: PCT/SE2023/050461

§ 371 (c)(1),
(2) Date: Nov. 8, 2024

(87) PCT Pub. No.: WO2023/219551

PCT Pub. Date: Nov. 16, 2023

(65) Prior Publication Data

US 2025/0295234 A1 Sep. 25, 2025

(30) Foreign Application Priority Data

May 11, 2022 (SE) ..... 2250568-9

(51) Int. Cl.
*A47B 91/00* (2006.01)
*A47B 91/02* (2006.01)

(52) U.S. Cl.
CPC ..... *A47B 91/00* (2013.01); *A47B 91/026* (2013.01)

(58) Field of Classification Search
CPC ..... A47B 91/00; A47B 91/02; A47B 91/022; A47B 91/024; A47B 91/026; A47B 2091/007; A47B 2220/0027
See application file for complete search history.

(56) References Cited

U.S. PATENT DOCUMENTS 4,934,639 A 6/1990 Domenig

FOREIGN PATENT DOCUMENTS

| | | | | |
|---|---|---|---|---|
| CN | 107174018 A | 9/2017 | | |
| EP | 0649617 A1 | 4/1995 | | |
| EP | 2653068 A1 | 10/2013 | | |
| KR | 100939298 B1 * | 1/2010 | ..... | A47B 91/026 |
| KR | 1020100122038 A * | 11/2010 | ..... | A47B 77/02 |
| KR | 20110033631 | 3/2011 | | |

(Continued)

OTHER PUBLICATIONS

Translation KR2011033631A (Year: 2011).*

*Primary Examiner* — Andrew Roersma
(74) *Attorney, Agent, or Firm* — Capitol City TechLaw

(57) ABSTRACT

A device may be provided for attaching a leg to a panel of a cabinet. The device may include a support portion, a first engagement portion defining a first main extension, and a second engagement portion defining a second main extension. The first main extension and the second main extension may be parallel to each other. The first engagement portion and the second engagement portion may be connected to the support portion spaced from each other. The device may be adapted for allowing relative displacement of the first engagement portion and the second engagement portion when a displacement structure of the device receives a correspondingly shaped end portion of the leg.

9 Claims, 8 Drawing Sheets

(56) References Cited

FOREIGN PATENT DOCUMENTS

| | | | | | |
|---|---|---|---|---|---|
| KR | 1020110025457 A | * | 3/2011 | ..... | A47B 91/024 |
| KR | 20180092111 | | 8/2018 | | |
| KR | 20200015118 | | 2/2020 | | |

* cited by examiner

DEVICE FOR ATTACHING A LEG TO A PANEL OF A CABINET

This application claims priority under 35 USC 119(a)-(d) from SE patent application No. 2250568-9 filed on May 11, 2022, the entire contents of which are incorporated herein by reference.

TECHNICAL FIELD

The invention relates to a device for attaching a leg to a panel of a cabinet according to the preamble of claim 1. The invention further relates to an arrangement comprising such a device and the leg. The invention further relates to a cabinet comprising such an arrangement.

Such a cabinet may be used in a kitchen or bathroom. A kitchen cabinet comprises a plurality of rectangular panels joined together to form a shape of a box defining an interior space for housing articles such as kitchen ware. The kitchen cabinet may be secured to a wall. Further, the kitchen cabinet may be provided with a number of legs for distancing the cabinet from the floor. More specifically, the legs are attached to an underside of a lowermost panel of the cabinet, which is horizontal when the panel is in its operational position. More specifically, one leg may be attached adjacent each corner of the rectangular lowermost panel.

According to prior art a device is known for attaching a leg to a panel of a cabinet, wherein the device comprises a plate-shaped rectangular support portion. Four engagement portions in the form of projections are arranged one at each corner of the plate-shaped rectangular support portion. The projections extend perpendicularly to an extension plane of the plate-shaped rectangular support portion. The projections are rigidly attached to the plate-shaped rectangular support portion. More specifically, the projections may be formed by dowels. The cabinet panel comprises four holes having a matching shape and dimension relative to the projections and in a similar configuration as the projections for receiving the projections in a way that the plate-shaped rectangular support portion may be attached to the cabinet panel. The securement of the device to the cabinet is thus based on friction between the peripheral surface of the projections and the associated surfaces defining the holes. Further, the plate-shaped rectangular support portion comprises a reception facing in an opposite direction relative to the projections, wherein the reception is accessible for an end portion of a leg in a way that the leg is secured to the panel.

Although the device described above has worked well, there are occasions where such a device is undesirably released from the cabinet during assembly of the cabinet.

SUMMARY

A first object of the invention is to provide a device for attaching a leg to a panel of a cabinet that creates conditions for a more firm securement of the leg to the cabinet.

The object is achieved by a device according to claim 1. Thus, it is achieved by a device for attaching a leg to a panel of a cabinet, wherein the device comprises a support portion, a first engagement portion defining a first main extension and a second engagement portion defining a second main extension, wherein the first main extension and the second main extension are in parallel with each other and wherein the first engagement portion and the second engagement portion are connected to the support portion spaced from each other, wherein each one of the first engagement portion and the second engagement portion comprises a projection or recess, wherein the projection or recess is adapted to be connected to a corresponding recess or projection in the cabinet panel, wherein the device is adapted for allowing relative displacement of the first engagement portion and the second engagement portion, and wherein the device comprises at least one opening or weak portion located between the first engagement portion and the second engagement portion for allowing the relative displacement between the first engagement portion and the second engagement portion, characterized in that the support portion is formed by a support plate defining a main extension plane, that the support plate is adapted for being connected to the cabinet panel in a way that the main extension plane of the support plate is in parallel with an extension plane of the cabinet panel, that the support plate comprises a base section, a first plate section provided with the first engagement portion and a second plate section provided with the second engagement portion, that at least one of the first plate section and the second plate section is spaced from the base section by the at least one opening or weak portion, that the device comprises a displacement structure adapted for effecting the displacement of the first engagement portion relative to the second engagement portion, wherein the displacement structure comprises a receptacle adapted to be at least partly widened when receiving a correspondingly shaped end portion of the leg, and that the at least one opening or weak portion forms a part of the receptacle so that the displacement of the first engagement portion relative to the second engagement portion is effected when the leg is received in the receptacle.

In this way, a more firm securement of the leg to the cabinet may be achieved, wherein the cabinet may be moved around after connection of the legs with a reduced risk that the legs may fall out.

The first main extension and the second main extension, respectively, defines a movement direction of the first engagement portion and the second engagement portion, respectively, for engagement with the cabinet panel. According to one example, the first engagement portion and the second engagement portion are connected to the support portion in a way that the support portion may be moved relative to the cabinet for engagement of the first engagement portion and the second engagement portion with the cabinet panel.

The cabinet panel may be provided with at least two engagement portions arranged spaced from each other and extending perpendicularly to a main extension plane of the cabinet panel, wherein the first engagement portion and the second engagement portion of the device is adapted for engagement with a respective one of the two engagement portions of the cabinet panel. According to one example, the device is adapted so that the displacement of the first engagement portion relative to the second engagement portion may be effected when the device is already engaged to the cabinet panel so that contact surfaces of the first engagement portion and the second engagement portion are urged against corresponding contact surfaces of the engagement portions of the cabinet panel.

In other words, the device may be engaged to the cabinet panel in a first operation, wherein the device is moved relative to the cabinet panel so that corresponding engagement portions are engaged with each other. In a subsequent second operation, the first engagement portion is displaced relative to the second engagement portion in a direction in parallel with a main extension plane of the cabinet panel.

Accordingly, in an applied state of the device, a contact pressure between adjacent contact surfaces of the engaging engagement portions may be uneven around the engagement portions.

According to one embodiment example, the device is adapted for allowing relative displacement of the first engagement portion and the second engagement portion away from each other. Thus, contact surfaces of the first engagement portion and the second engagement portion facing away from each other are urged against corresponding contact surfaces of the engagement portions of the cabinet panel during assembly.

Also, the device may be adapted for allowing a small eccentricity of the projection in its associated recess when the first engagement portion is in the displaced state relative to the second engagement portion.

According to one example, the at least two engagement portions of the cabinet panel are formed by holes and the first engagement portion and the second engagement portion of the device are formed by projections, wherein an inner shape and dimension of the holes is adapted for matching an outer shape and dimension of the projections. According to one example, the holes have a circular cross section shape. According to a further example, the projections have a circular cross section shape. According to one example, there may be a press fit between the mutually matching projections and openings. According to one alternative, thanks to the displaceability of the engagement portion(s), the displaceable projection may be designed with a slightly smaller external cross section shape than its associated hole, wherein engagement between the projection and the hole is achieved resulting from the displacement. In an operational state, ie after displacement of the projections having such a circular cross section shape, roughly half the envelope surface of the projection may be in contact with the adjacent part of the contact surface of the hole while the other half may be somewhat spaced from its corresponding adjacent part of the contact surface of the hole.

Each one of the projections of the device may be formed by a so-called dowel. A dowel is a cylindrical rod, usually made of wood, plastic, or metal. An envelope surface of the dowel may have a structure of spaced ribs/valleys running in an extension direction of the dowel. The ribs of the dowel may penetrate the material of the cabinet panel during engagement. The cabinet panel may be formed by chipboard. Further, such a design of the dowel provides for a path for air (and excess glue, if applicable) to escape when the dowel is pressed into place. In this application, dowels are used as structural reinforcements for securement of the cabinet legs.

The above-mentioned opening or weak portion located between the first engagement portion and the second engagement portion for allowing the relative displacement between the first engagement portion and the second engagement portion may be provided in the support portion and extend throughout the support portion in the extension direction of the first engagement portion. Such an opening may therefore allow relative movement between the first engagement portion and the second engagement portion perpendicular to the extension direction of the first engagement portion. Such an opening may have the form of a slot.

According to a further development of the last-mentioned embodiment example, the at least one opening or weak portion is located on opposite sides of at least one of the first engagement portion and the second engagement portion in the displacement direction for allowing the relative displacement.

According to a further development of the last-mentioned embodiment example, the at least one opening or weak portion is formed by a slot which has an extension so that it surrounds the at least one of the first engagement portion and the second engagement portion on three sides for allowing the relative displacement. The slot may have a generally U-shaped extension.

The support plate is preferably designed with two opposite main surfaces, which are in parallel with each other. The support plate is preferably designed so that a main surface thereof is flat and adapted to be in contact with a lower surface of the cabinet panel.

According to one example, the first engagement portion is connected to the first plate section in a way that the first main extension is perpendicular to the main extension plane of the support plate. Likewise, the second engagement portion is connected to the second plate section in a way that the second main extension is perpendicular to the main extension plane of the support plate.

According to one example, the first engagement portion is rigidly connected to the first plate section. Likewise, the second engagement portion is rigidly connected to the second plate section. The first engagement portion may be formed in one piece with the first plate section. Likewise, the second engagement portion may be formed in one piece with the second plate section.

According to one example, each one of the first engagement portion and the second engagement portion is displaceable relative to the base section.

According to one example, the support portion has a symmetrical design with regard to a plane extending perpendicularly to the main extension plane of the support plate, wherein the first engagement portion and the second engagement portion are arranged on opposite sides of the symmetry plane and displaceable away from the symmetry plane. Such a design creates conditions for the support portion being not moved relative to the cabinet panel during the relative displacement of the engagement portions.

According to a further embodiment example, at least one of the first plate section and the second plate section is elastically connected to the base section for allowing an elastic movement in parallel with the main extension plane of the support plate. Thus, at least one of the first plate section and the second plate section is elastically moveable relative to the base section. According to one example, the at least one of the first plate section and the second plate section has an elongated shape and is defined by a slot extending along both long sides and one of the short sides, wherein the slot has a width allowing the movement of the plate section and wherein the other short side forming a bridge to the base section. In other words, the other short side forming the bridge to the base section may be seen to form a hinge portion for the elastic movement.

It was mentioned above that the displacement structure comprises a receptacle adapted to be at least partly widened when receiving a correspondingly shaped end portion of the leg. In other words, sections of the device external of the receptacle may be moved outwards accordingly. The receptacle may be formed by a slot.

Further, the relative displacement of the first engagement portion and the second engagement portion may be effected when the end portion of the leg is received in the receptacle. According to one example, the opening forms a slot that partly branches off from the slot forming the receptacle.

It creates conditions for an easy assembly, wherein an end-user assembling the furniture will automatically achieve the relative displacement between the first engagement portion and the second engagement portion and thereby a rigid attachment when attaching the leg to the support plate.

In one embodiment, the displacement structure comprises a receptacle adapted to be at least partly widened when receiving a correspondingly shaped object. In a further embodiment, the at least one opening or weak portion forms a part of the receptacle so that the displacement of the first engagement portion relative to the second engagement portion is effected when the object is received in the receptacle.

The displacement structure may be adapted for being effected by an end portion of the leg so that the first engagement portion is displaced relative to the second engagement portion when the end portion of the leg is attached to the displacement structure.

According to one example, the first engagement portion, the second engagement portion and the displacement structure are arranged at the corners of a triangular shape at the support portion. More specifically, both the first engagement portion and the second engagement portion may simultaneously be pressed outwards when the displacement structure is effected.

According to a further development of the last-mentioned embodiment example, the first engagement portion and the second engagement portion are arranged adjacent opposite ends of the support structure and wherein the displacement structure is located in a central area of the support structure. It creates conditions for a facilitated assembly and a rigid construction.

According to a further embodiment example, the device is adapted for allowing displacement of the first engagement portion relative to the second engagement portion while maintaining an outer peripheral shape of the device non-effected. In other words, the device comprises a frame that is not effected by the displacement of the first engagement portion relative to the second engagement portion. In this way, rigidity of the device is secured, which is important in case the device forms a structural part bearing weight of the cabinet in an operational state of the cabinet. Further, in use, an elongated plate-like cover may be arranged below the cabinet along the floor for covering a distance between the cabinet and the floor. Such an elongated cover may be attached to the front legs via clips and be supported by the device, wherein such a rigid frame provides for a proper support in case the cover is subjected to external shocks, such as by a vacuum cleaner during cleaning.

According to a further aspect of the invention, it regards an arrangement for distancing a cabinet from a floor, wherein the arrangement comprises a device according to any one of the examples as above and a leg adapted to be attached to a panel of the cabinet via the device.

According to one embodiment example, the upper portion of the leg and/or a wall portion defining the receptacle of the displacement structure has a tapering shape for subjecting the wall portion of an increasing force during attachment in order to gradually effect the displacement. According to one example, the receptacle may have a tapering cross section shape with a larger entry for ease of assembly.

According to a further aspect of the invention, it regards a cabinet comprising an arrangement as above, wherein the cabinet panel is provided with at least two engagement portions arranged spaced from each other and extending perpendicularly to a main extension plane of the cabinet panel, wherein the first engagement portion and the second engagement portion of the device is adapted for engagement with a respective one of the two engagement portions of the cabinet panel and wherein the device is adapted so that the displacement of the first engagement portion relative to the second engagement portion may be effected when the device is attached to the cabinet panel so that contact surfaces of the first engagement portion and the second engagement portion are urged against corresponding contact surfaces of the engagement portions of the cabinet panel.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS

Figure 1:
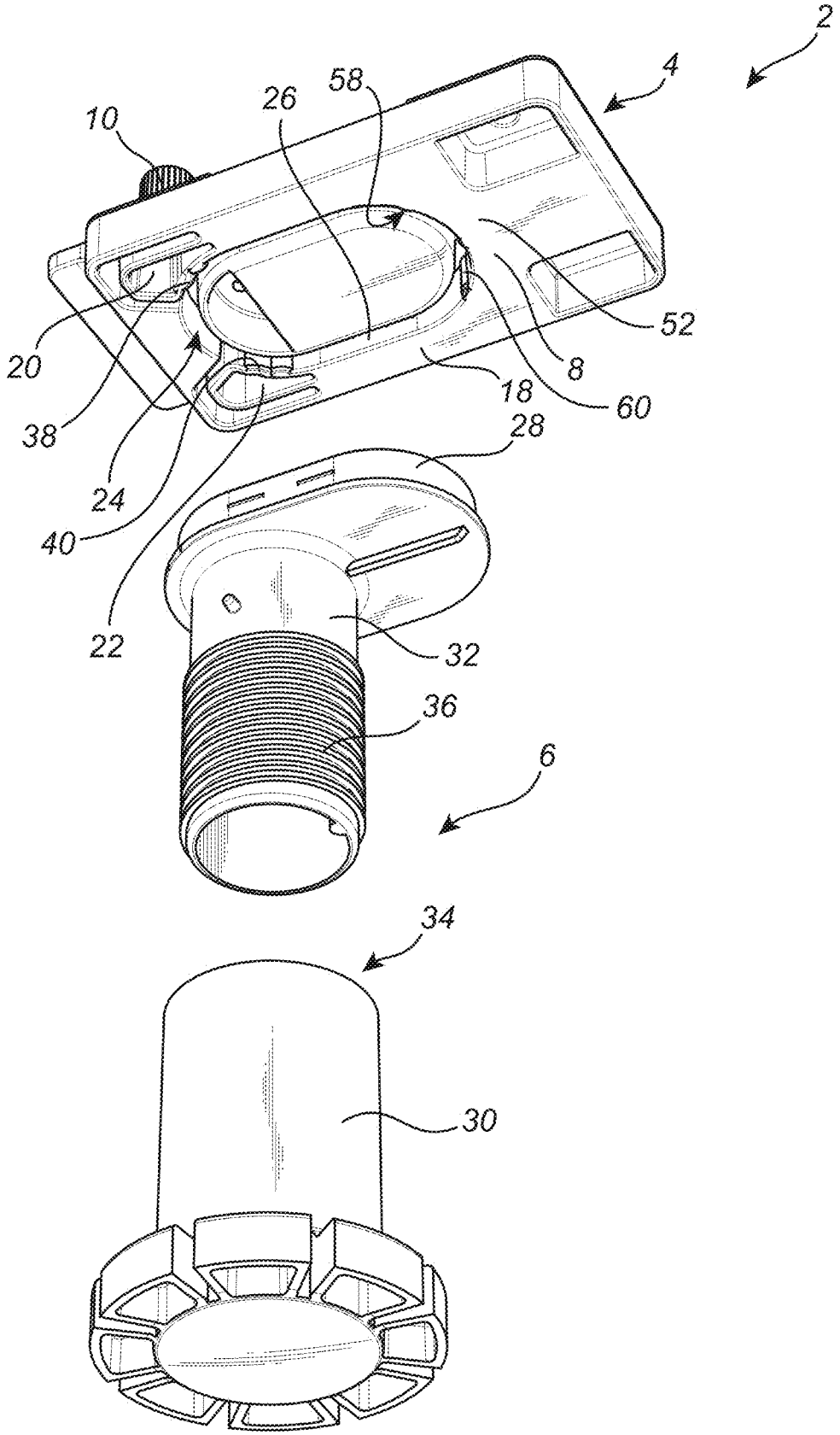
FIG. 1 is a perspective exploded view from below of an arrangement comprising an attachment device and a leg for distancing a cabinet from the floor according to a first embodiment.
Figure 2A:
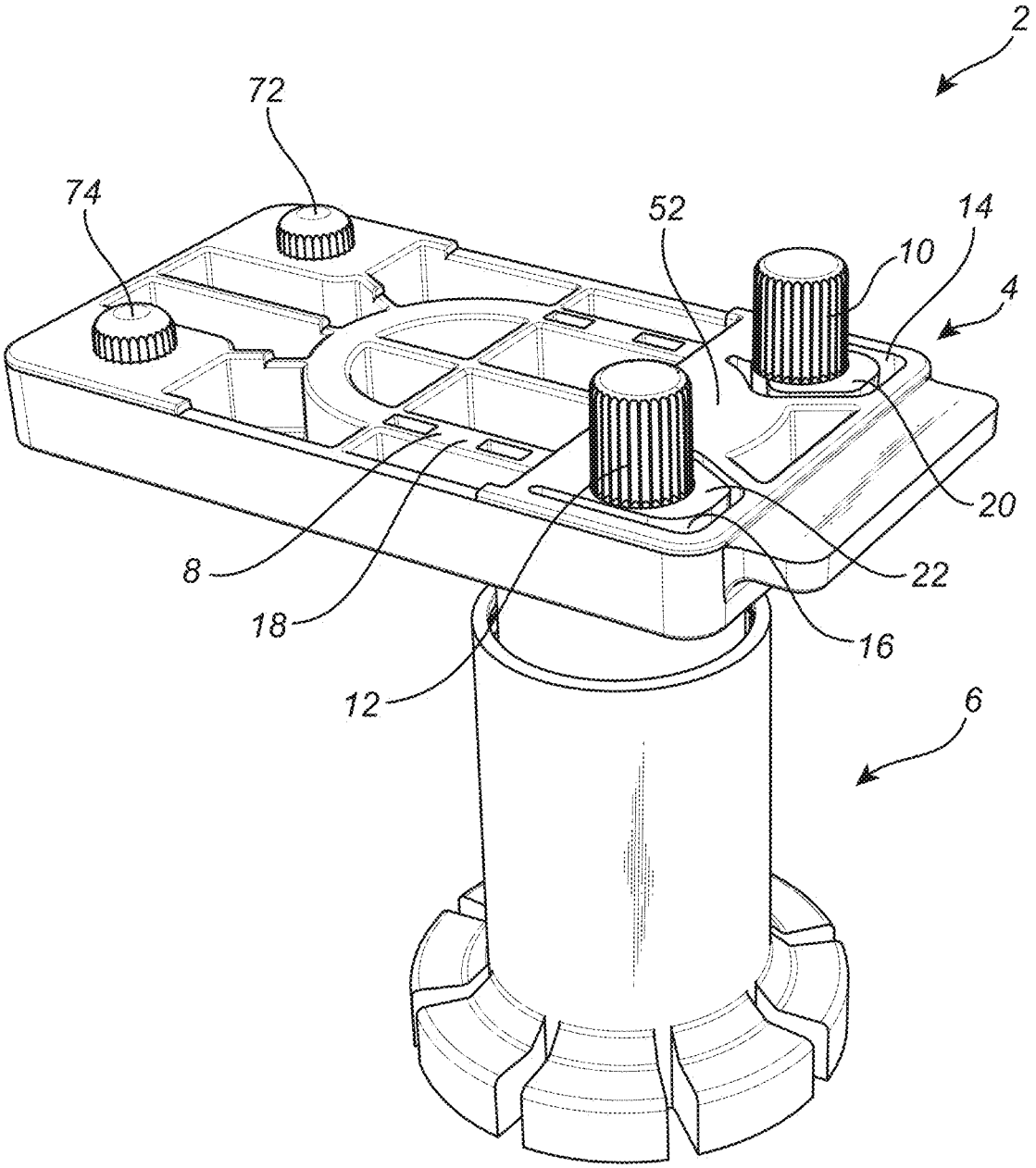
FIG. 2*a* is a perspective top view of the arrangement according to FIG. 1 in an assembled state.
Figure 2B:
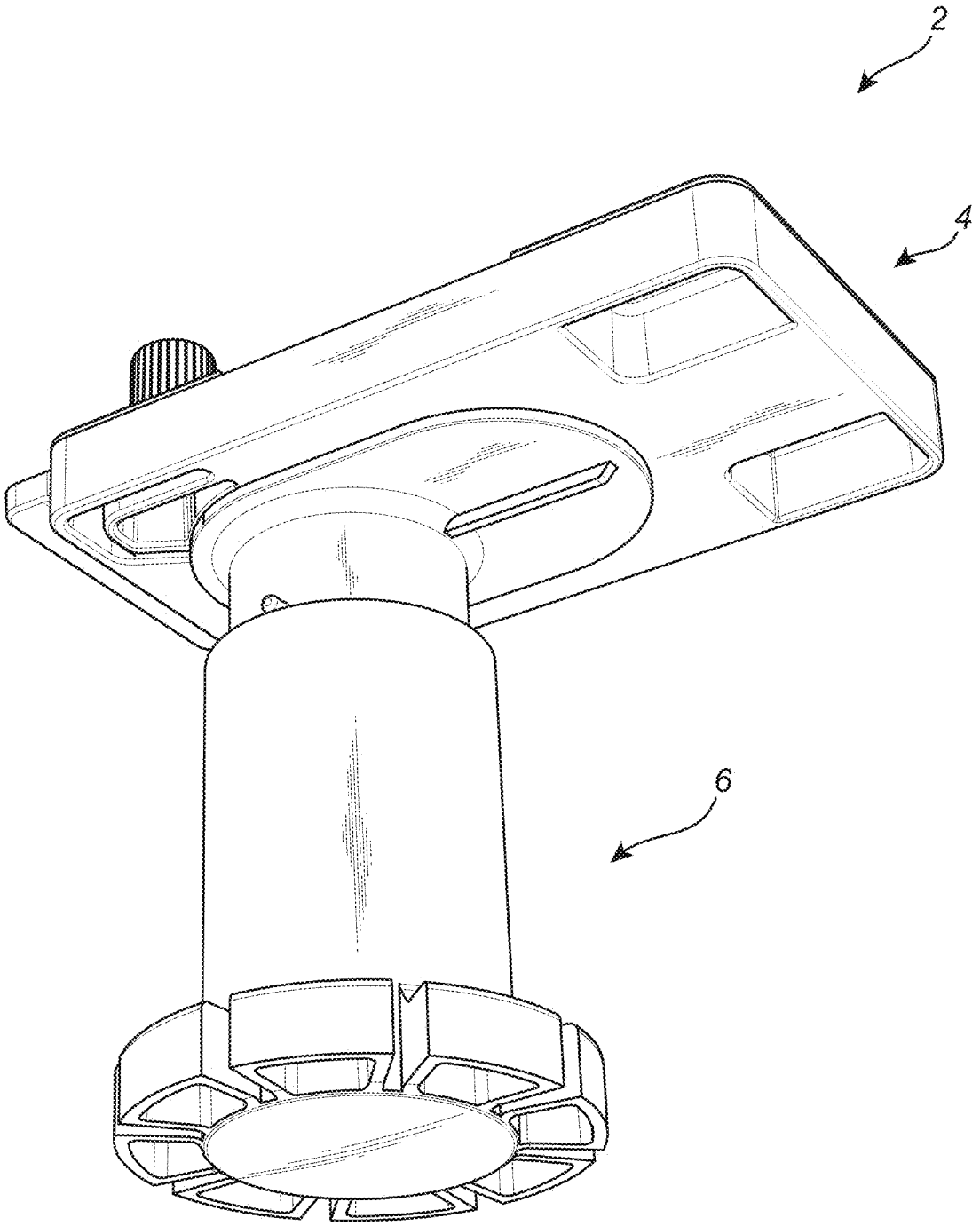
FIG. 2*b* is a perspective view from below of the arrangement according to FIG. 2*a*.

FIG. 1 is a perspective exploded view from below of an arrangement 2 comprising an attachment device 4 and a leg 6 for distancing a cabinet 42 from the floor (see FIG. 4) according to a first embodiment. FIG. 2*a* is a perspective top view of the arrangement 2 according to FIG. 1 in an assembled state and FIG. 2*b* is a similar perspective view of the arrangement 2 from below.

The device 4 comprises a support portion 8, a first engagement portion 10 defining a first main extension and a second engagement portion 12 defining a second main extension, wherein the first main extension and the second main extension are in parallel with each other. The term main extension here refers to a connection direction of the respective engagement portion 10, 12. Further, the first engagement portion 10 and the second engagement portion 12 are connected to the support portion 8 spaced from each other in a direction perpendicular to the main extensions thereof. The device 4 is adapted for allowing relative displacement of the first engagement portion 10 and the second engagement portion 12. In the shown embodiment, the device 4 is adapted for allowing relative displacement of the first engagement portion 10 and the second engagement portion 12 away from each other. In other words, the device is adapted for allowing displacement of the first engagement portion 10 relative to the second engagement portion 12 from a first mutual relationship to a second mutual relationship, wherein the first engagement portion 10 and the second engagement portion 12 are spaced to a different extent in the second mutual relationship. In the shown embodiment, the first engagement portion 10 and the second engagement portion 12 are spaced to a greater extent in the second mutual relationship. It is shown in more detail in an example assembly in FIG. 5*a* and FIG. 5*b*.

Each one of the first engagement portion 10 and the second engagement portion 12 is formed by a projection. The respective projection is adapted to be received in a corresponding recess in the cabinet panel. The projection is formed by a pin in the form of a dowel. The dowel has a constant cross section in its extension direction. More specifically, the dowel defines a circular cross section shape. An envelope surface of the dowel is adapted for a frictional engagement with a corresponding surface defining the hole. The first engagement portion 10 and the second engagement portion 12 are identical in design and structure.

The device 4 comprises a first opening 14 partly surrounding the first engagement portion 10 and a second opening 16 partly surrounding the second engagement portion 12 for allowing the relative displacement between the first engagement portion 10 and the second engagement portion 12. Each one of the first opening 14 and the second opening 16 is formed by a slot. Each one of the slots has a continuous extension so that it surrounds the first engagement portion 10 and the second engagement portion 12 on three sides for allowing the relative displacement. More specifically, each one of the slots has a generally U-shaped extension.

The support portion 8 is formed by a support plate 18 defining a main extension plane, wherein the support plate 18 is adapted for being connected to the cabinet panel in a way that the main extension plane of the support plate is in parallel with an extension plane of the cabinet panel. The support plate 18 comprises a base section 52, a first plate section 20 provided with the first engagement portion 10 and a second plate section 22 comprising the second engagement portion 12, wherein the first plate section 20 and the second plate section 22 are spaced from the base section 52 in parallel with the main extension plane by the at least one opening 14, 16. More specifically, each one of the slot-like openings 14, 16 defines the first plate section 20 and the second plate section 22, respectively.

The projection defining the first engagement portion 10 extends perpendicularly to an extension plane of the first plate section 20. More specifically, the projection defining the first engagement portion 10 is formed in one piece with the first plate section 20. In a similar manner, the projection defining the second engagement portion 12 extends perpendicularly to an extension plane of the second plate section 22. More specifically, the projection defining the second engagement portion 12 is formed in one piece with the second plate section 22.

More specifically, each one of the first plate section 20 and the second plate section 22 has an elongated shape and is defined by the slot 14, 16 extending along both long sides and one of the short sides. Further, the slot 14, 16 has a width allowing the movement of the plate section 20, 22 in the extension plane of the plate section 18. Further, the other short side forming a bridge to the base section 52 may be defined to form a hinge for the elastic movement. In other words, each one of the elongated plate sections 20, 22 is pivoted around said short side forming the hinge in parallel with the extension plane of the plate section 18.

The device 4 comprises a displacement structure 24 adapted for effecting the displacement of the first engagement portion 10 relative to the second engagement portion 12. The displacement structure 24 comprises a receptacle 26 adapted to be at least partly widened when receiving an upper portion 28 of the leg 6. Each one of the openings 14, 16 forms a part of the receptacle 26. Further, the receptacle 26 has the shape of a slot. More specifically, the slot-like receptacle 26 has a rounded circumscribing shape, especially an oval shape. Likewise, the upper portion 28 of the leg 6 comprises a wall or ring with a rounded circumscribing shape, especially an oval shape, matching the dimensions of the slot-like receptacle 26.

More specifically, each one of the first plate section 20 and the second plate section 22 is defined in a direction towards the displacement structure 24 by the slot-like receptacle 26. When the leg 6 is attached to the displacement structure 24, walls of each one of the first plate section 20 and the second plate section 22 defining the receptacle will be pushed radially outwards. More specifically, each one of the first plate section 20 and the second plate section 22 comprises a wall 38, 40 defining the slot-like receptacle 26. Each one of the walls 38, 40 has at least one convex contact surface facing the slot-like receptacle 26. More specifically, each one of the walls 38, 40 has two adjacent convex contact surfaces facing the slot-like receptacle 26. Similarly, the base section 52 comprises a wall 58, 60 defining the slot-like receptacle 26 on an opposite side of the receptacle 26, wherein the walls 58, 60 forms rigid support surfaces for the leg 6 during attachment.

More specifically, the displacement structure 24 is adapted for being effected by an end portion 28 of the leg 6 so that the first engagement portion 10 is displaced relative to the second engagement portion 12 when the end portion 28 of the leg 6 is attached to the displacement structure 24. More specifically, each one of the first engagement portion 10 and the second engagement portion 12 is displaced outwards relative to the base section 52.

The first engagement portion 10, the second engagement portion 12 and the displacement structure 24 are arranged at the corners of a triangular shape at the support structure 8. More specifically, the first engagement portion 10 and the second engagement portion 12 are arranged adjacent opposite ends of the support structure 8 and wherein the displacement structure 24 is located in a central area of the support structure 8. More specifically, the support plate 18 has a generally rectangular shape, wherein each one of the first engagement portion 10 and the second engagement portion 12 are arranged adjacent a respective corner of the rectangular support plate 18.

The device 4 is adapted for allowing displacement of the first engagement portion 10 relative to the second engagement portion 12 while maintaining an outer peripheral shape of the device non-effected. It is achieved in that the openings/slots 14, 16 extends on an outer side of the first engagement portion 10 and the second engagement portion 12, respectively, wherein the opening/slot has such a width that each one of the first plate section 20 and the second plate section 22 may be moved somewhat outwards.

Turning now again to FIG. 1. The leg 6 comprises two parts 30, 32 adapted for height adjustment of the leg. More specifically, the leg 6 is adapted for a stepless (continuous) height adjustment. Each one of the leg parts 30, 32 has a cylindrical shape, wherein one of the leg parts 30 has a cylindrical hollow shape adapted for receipt of the other leg 32. More specifically, envelope surfaces of each one of the leg parts 30, 32 have a threaded structure 34, 36.

Further, the device comprises two additional engagement portions 72, 74. Each one of the additional engagement portions 72, 74 is also formed by a projection in the form of a dowel and extends in parallel with the first and second engagement portions 10, 12. Each one of the additional engagement portions 72, 74 is rigidly attached to the support portion 8. Thus, the additional engagement portions 72, 74 are arranged in a non-movable way in relation to each other. Further, each one of the additional engagement portions 72, 74 is arranged adjacent a corner of the rectangular support plate 18. In other words, the device comprises four engagement portions 10,12,72,74, which are arranged in a configuration defining the corners of a rectangle.

The upper portion 28 of the leg 6 has an upwards tapering shape for subjecting the wall portion defining the receptacle of the displacement structure 24 of an increasing force during attachment in order to gradually effect the displacement. According to an alternative or complement, the slot-like receptacle 26 may have a shape tapering inwards from an opening.

Figure 3A:
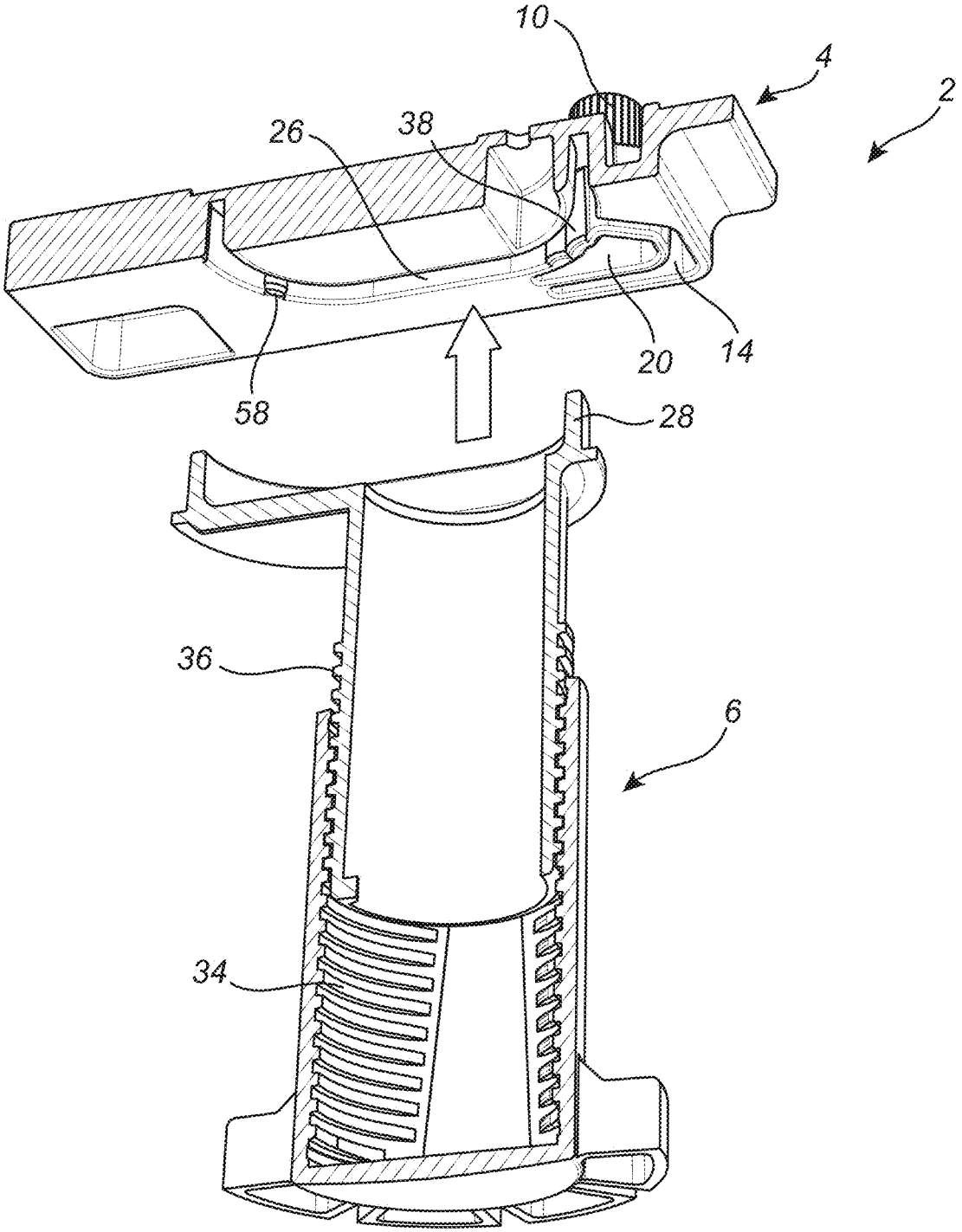
FIG. 3*a* is a partly cut perspective view from below of the arrangement according to FIG. 2*a* during attachement.
Figure 3B:
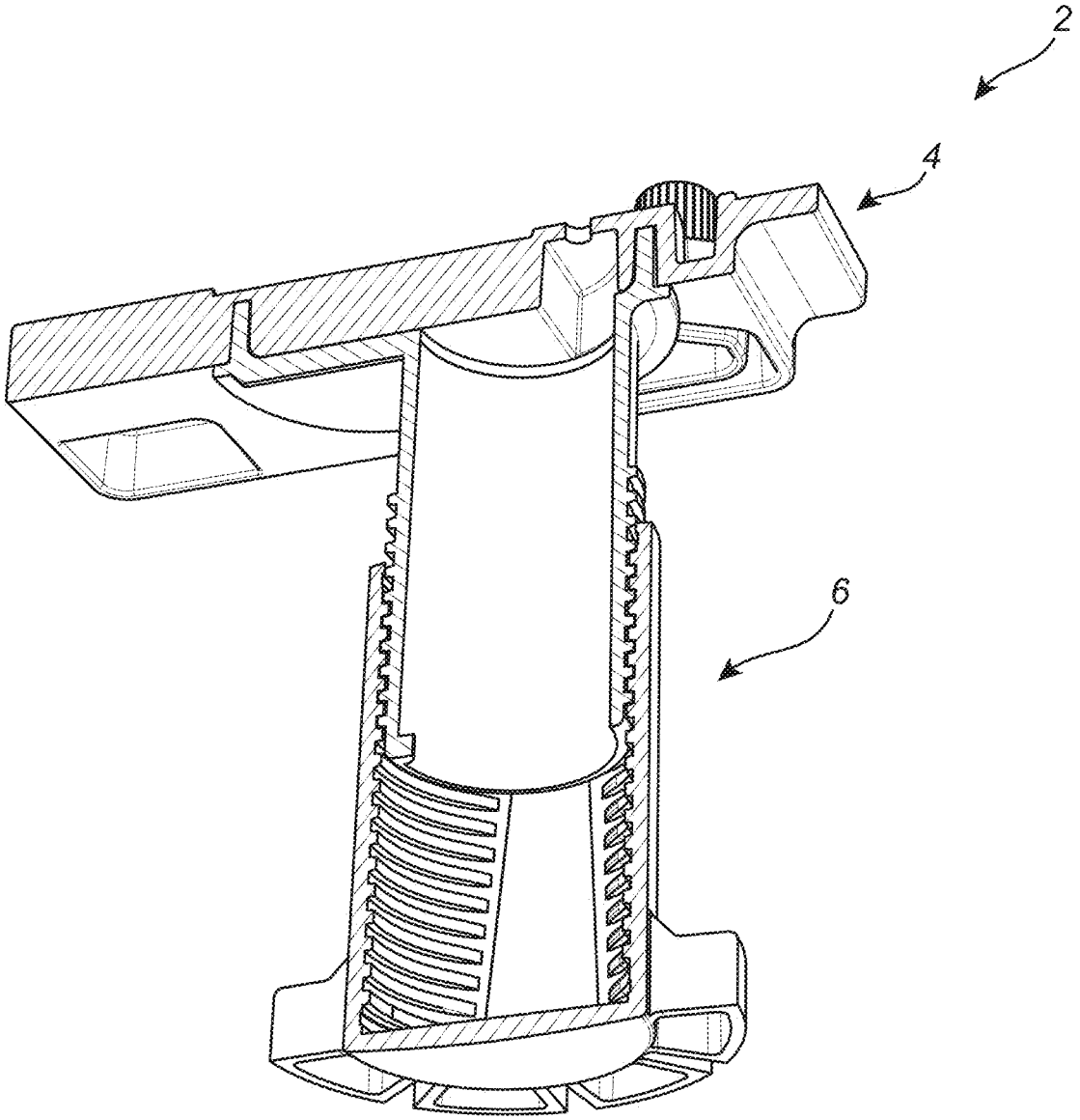
FIG. 3*b* is a partly cut perspective view from below of the arrangement according to FIG. 3*a* in an attached state.

FIG. 3*a* is a partly cut perspective view from below of the arrangement 2 according to FIG. 2*a* during attachment. The leg 6 is assembled by the leg parts 30, 32 so that the threads 34, 36 are in engagement. Further, the device 4 is attached to the cabinet panel 44 (see also FIG. 4). In a consecutive step, the leg 6 is moved straight (in parallel with an extension direction of the leg 6) towards the device 4, see arrow, so that the upper portion 28 of the leg 6 is received in the slot-like receptacle 26 of the device 4. Due to the relative tapering shape of the contact surfaces of the upper portion 28 and the slot-like receptacle 26, the plate sections 20, 22 (and thereby the projections/dowels 10, 12) will be displaced outwards during the engagement. FIG. 3*b* is a partly cut perspective view from below of the arrangement according to FIG. 3*a* in an attached state.

Figure 4:
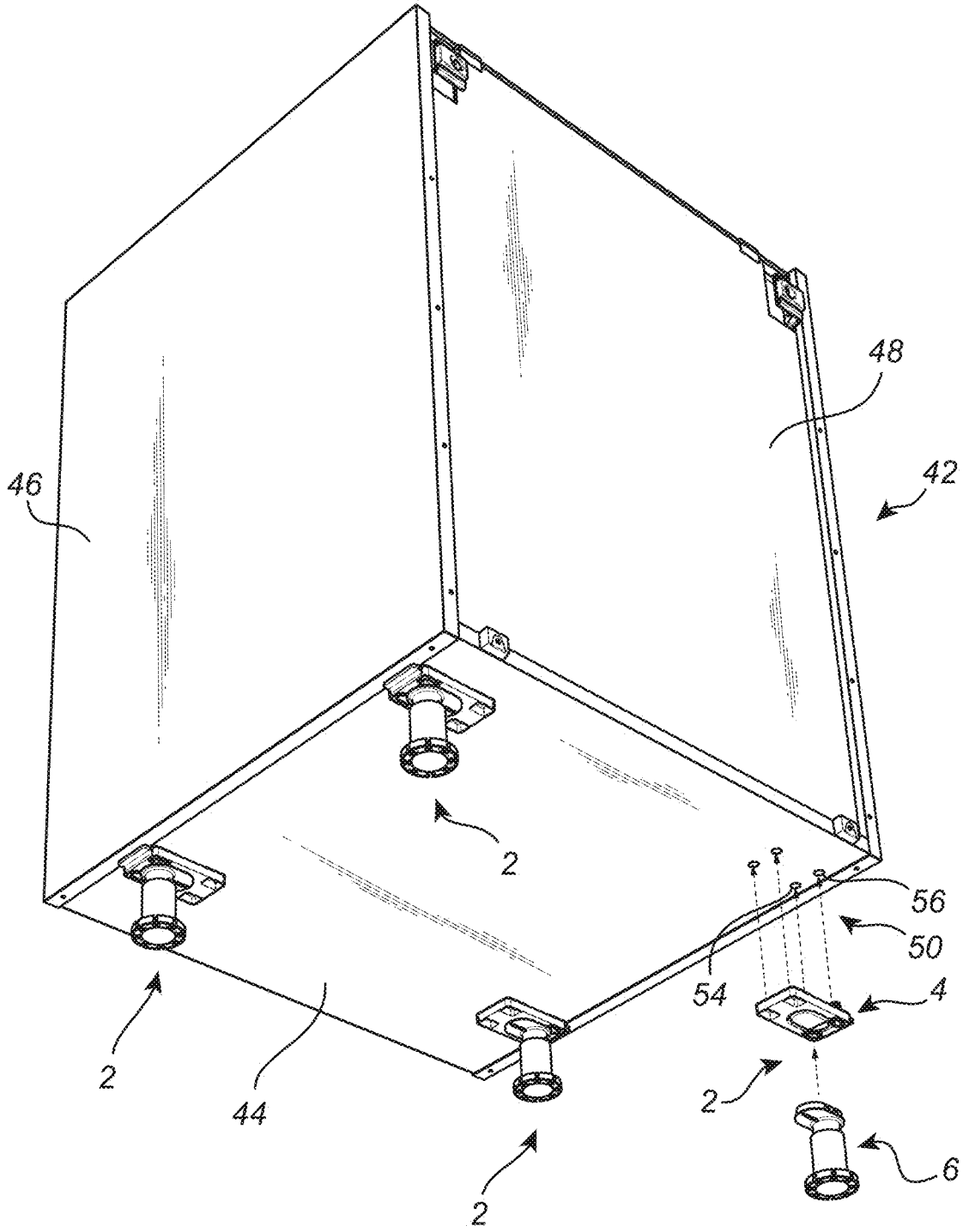
FIG. 4 is a perspective view from below of a cabinet being provided with arrangements as in FIG. 3*b* at each corner.

FIG. 4 is a perspective view from below of a cabinet 42. The cabinet 42 comprises a plurality of rectangular panels 44, 46, 48 joined together to form a shape of a box defining an interior space for housing articles such as kitchen ware. A lowermost panel 44 is provided with arrangements 2 as described above at each corner for distancing the cabinet 42 from a floor. More specifically, at each corner, the lowermost panel 44 is provided with a hole pattern 50 matching a projection pattern defined by the engagement portions 10, 12, 72, 74 of the device 4. More specifically, the hole pattern 50 comprises four holes 54, 56, wherein the holes are arranged in the corners of a rectangle.

Figure 5A:
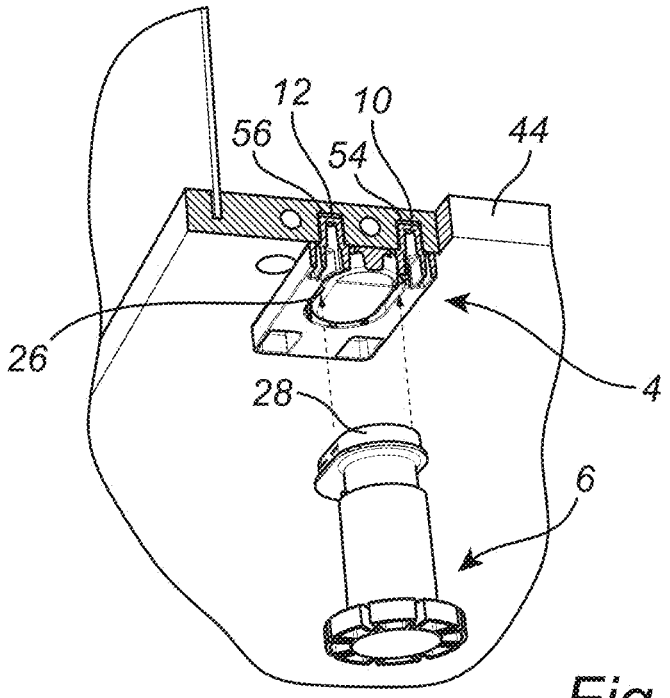
FIG. 5*a* and FIG. 5*b* show an arrangement as in FIG. 4 in two consecutive assembly steps in partly cut perspective views from below.
Figure 5B:
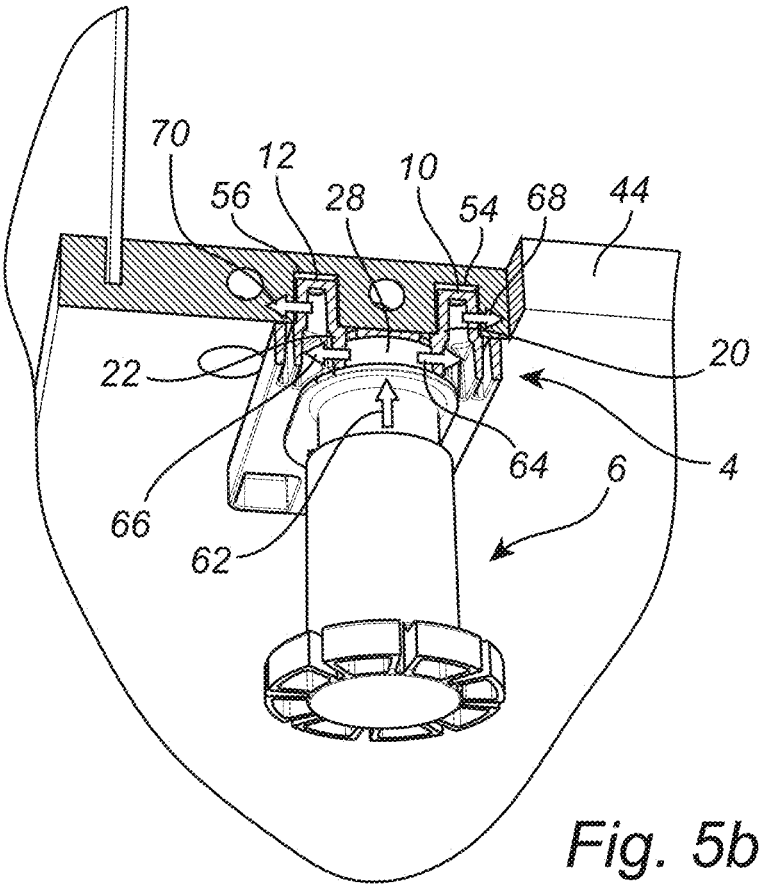

FIG. 5*a* and FIG. 5*b* show an arrangement as in FIG. 4 in two consecutive assembly steps in partly cut perspective views from below. In FIG. 5*a*, the device 4 is arranged so that the engagement portions 10, 12, 72, 74 are received in the holes 54, 56 of the hole pattern 50 in the lowermost panel 44. In FIG. 5*b*, the leg 6 is moved upwards, see arrow 62, so that its upper portion 28 enters the receptacle 26, wherein the first plate section 20 and the second plate section 22 are moved away from each other in a horizontal plane, see arrows 64, 66, and consequently the first engagement portion 10 and the second engagement portion 12 are moved away from each other in the horizontal plane, see arrows 68, 70.

Figure 6A:
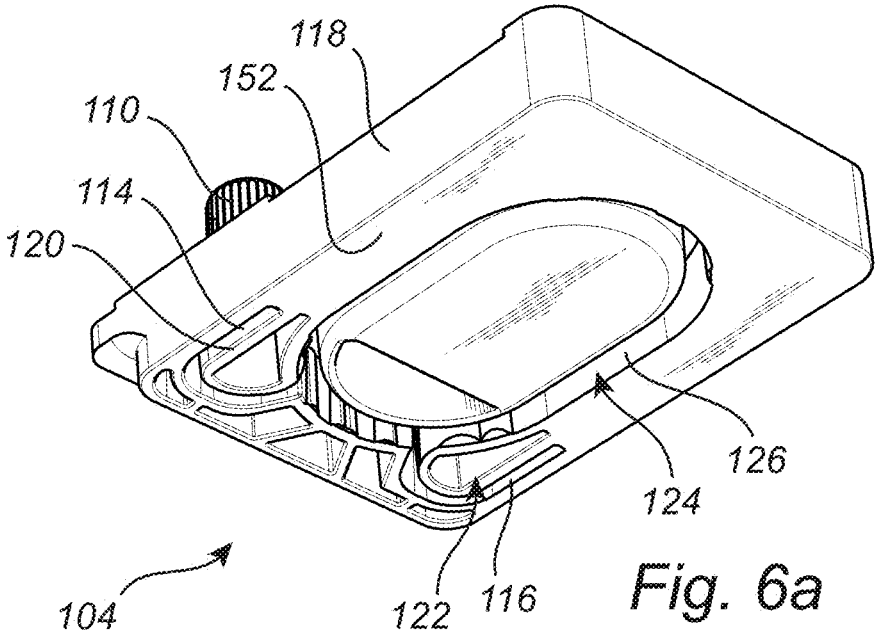
FIG. 6*a* is a perspective view from below of a device for attaching a leg to a panel of a cabinet according to a second embodiment.
Figure 6B:
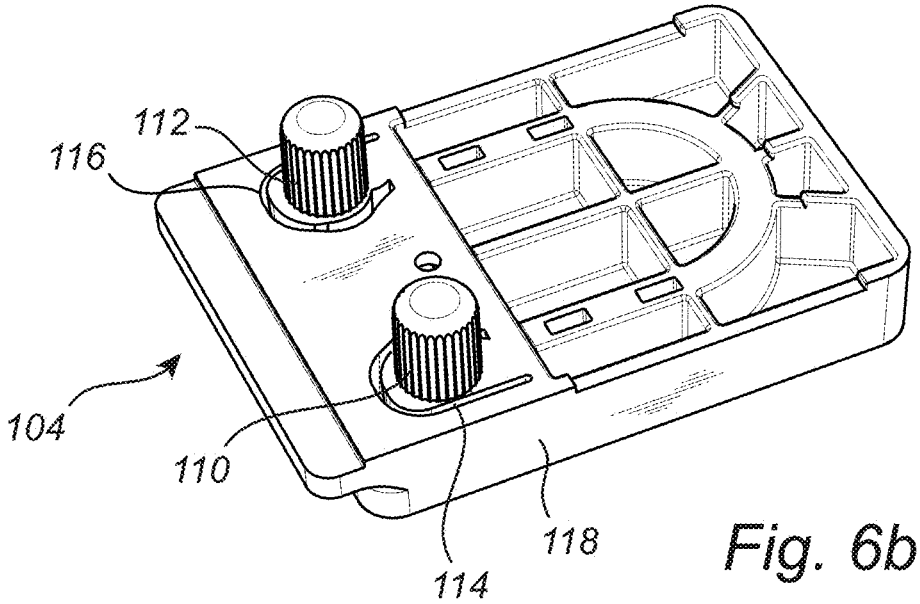
FIG. 6*b* is a perspective view from above of the device according to FIG. 6*a*.

FIG. 6*a* is a perspective view from below of a device 104 for attaching the leg 6 to the panel 44 of the cabinet 42 according to a second embodiment, and FIG. 6*b* is a perspective view from above of the device 104 according to FIG. 6*a*.

The device 104 comprises a support portion 108, a first engagement portion 110 defining a first main extension and a second engagement portion 112 defining a second main extension, wherein the first main extension and the second main extension are in parallel with each other. The structure and function of the support portion 108 and the first and second engagement portions 110, 112 are similar as has been described above for the first embodiment and will for ease of presentation not be repeated in detail.

The device 104 comprises a first opening 114 partly surrounding the first engagement portion 110 and a second opening 116 partly surrounding the second engagement portion 112 for allowing the relative displacement between the first engagement portion 110 and the second engagement portion 112. Each one of the first opening 114 and the second opening 116 is formed by a slot. Each one of the slots has a continuous extension so that it surrounds the first engagement portion 110 and the second engagement portion 112 on three sides for allowing the relative displacement.

The support portion 108 is formed by a support plate 118 defining a main extension plane, wherein the support plate 118 is adapted for being connected to the cabinet panel 44 in a way that the main extension plane of the support plate is in parallel with an extension plane of the cabinet panel. The support plate 118 comprises a base section 152, a first plate section 120 provided with the first engagement portion 110 and a second plate section 122 comprising the second engagement portion 112, wherein the first plate section 120 and the second plate section 122 are spaced from the base section 152 in parallel with the main extension plane by the at least one opening 114, 116. More specifically, each one of the slot-like openings 114, 116 defines the first plate section 120 and the second plate section 122, respectively.

The device 104 comprises a displacement structure 124 adapted for effecting the displacement of the first engagement portion 110 relative to the second engagement portion 112. The displacement structure 124 comprises a receptacle 126 adapted to be at least partly widened when receiving the upper portion 28 of the leg 6. Each one of the openings 114, 116 forms a part of the receptacle 126. Further, the receptacle 126 has the shape of a slot. More specifically, the slot-like receptacle 126 has a rounded circumscribing shape, especially an oval shape. Likewise, the upper portion 28 of the leg 6 comprises a wall or ring with a rounded circumscribing shape, especially an oval shape, matching the dimensions of the slot-like receptacle 126.

The support plate 118 has a generally rectangular shape, wherein each one of the first engagement portion 110 and the second engagement portion 112 are arranged adjacent a respective corner of the rectangular support plate 118.

In contrast to the first embodiment of the device 4, there are no additional engagement portions in the second embodiment of the device 104 (compare references 72, 74 in FIG. 2*a*). In other words, the first engagement portion 110 and the second engagement portion 112 are the only engagement portions. It creates conditions for a more cost-effective production of the second embodiment of the device 104.

Further, the support plate 118 in the second embodiment of the device 104 has a somewhat smaller extension in a direction perpendicular to a plane in parallel with the extensions of the engagement projections 110, 112. It creates conditions for use of a lower amount of material, which in turn creates further conditions for a more cost-effective production.

It is to be understood that the present invention is not limited to the embodiments described above and illustrated in the drawings; rather, the skilled person will recognize that many changes and modifications may be made within the scope of the appended claims.

According to the embodiments of the device as described above, both the first engagement portion and the second engagement portion are adapted to be displaced relative to a base section of the support plate. According to one alternative, the device comprises a single displaceable engagement portion. Thus, the device may comprise four engagement portions as shown in the FIGS. 1-5 or two engagement portions as shown in the FIGS. 6*a* and 6*b*, wherein only one is displaceably arranged. According to one further alternative, all four engagement portions may be adapted to be displaced relative to a base section of the support plate.

According to the embodiments of the device as described above, the engagement portions are formed by dowels having a structure of a plurality of spaced elongated ribs extending in parallel with an extension direction of the dowel. According to one alternative, the engagement portions are formed by dowels having a structure of a plurality of spaced ribs extending in a transverse direction relative to an extension direction of the dowel. More specifically, the ribs may be arranged perpendicularly relative to the extension direction of the dowel, thereby forming a plurality of axially spaced and radially projecting rings. Such a structure may form a stronger grip in the material of the cabinet panel.

According to the embodiments of the device as described above, the engagement portions are arranged at the same nominal distance from each other as the corresponding holes in the cabinet panel. Thus, an increased contact pressure/friction due to the relative displacement of the engagement portions is achieved first when the leg is attached.

According to one alternative, the engagement portions are arranged at a somewhat larger nominal distance from each other compared to the corresponding nominal distance between the corresponding holes in the cabinet panel. In this way, an increased contact pressure/friction due to the relative displacement of the engagement portions is achieved already when the support plate is attached to the cabinet panel.

According to the embodiment shown in FIG. 4, the lowermost panel 44 of the cabinet 42 is provided with four sets of hole patters, one at each corner of the rectangular panel, for engagement of four legs, one at each corner of the rectangular panel. Thus, all four legs are associated to a single cabinet 42. According to one alternative, the lowermost panels of two adjacent cabinets may each be provided with a subset of one such hole pattern so that the support plate bridges the two cabinets. For example, two of said holes in one single hole pattern may be provided in the lowermost panel of a first one of the adjacent cabinets and the other two of said holes in the single hole pattern may be provided in the lowermost panel of a second one of the adjacent cabinets.

According to one alternative, the attachment device is adapted for allowing relative displacement of the first engagement portion and the second engagement portion towards each other. The displacement structure of the attachment device adapted for effecting the displacement of the first engagement portion relative to the second engagement portion may then be redesigned. More specifically, the receptacle and the associated upper portion of the leg may be designed for achieving the relative displacement of the first engagement portion and the second engagement portion towards each other when the leg is received in the receptacle during assembly.

According to one further alternative embodiment, at least one of and preferably each one of the first engagement portion and the second engagement portion is formed by a recess instead of a projection. The recess may be formed by a hole having an elongated, circular-cylindrical shape. Thus, the recess may be provided in the first plate section and the second plate section, respectively. Accordingly, the panel may be provided with correspondingly shaped projections for being received in the recesses. According to a further alternative, recesses are provided both in the support plate and in the panel, wherein a separate circular-cylindrical fastening element, such as a dowel, is received in such two recesses in the support plate and in the panel for fastening the device to the panel.

The invention claimed is:

1. A device for attaching a leg to a panel of a cabinet, the device comprising:

a support portion;

a first engagement portion defining a first main extension;

a second engagement portion defining a second main extension;

wherein the first main extension and the second main extension are parallel to each other;

wherein the first engagement portion and the second engagement portion are connected to the support portion spaced from each other;

wherein each one of the first engagement portion and the second engagement portion includes a projection or recess that is adapted to be connected to a corresponding recess or projection in the panel;

wherein the device is adapted for allowing relative displacement of the first engagement portion and the second engagement portion;

at least one opening or weak portion located between the first engagement portion and the second engagement portion for allowing the relative displacement between the first engagement portion and the second engagement portion;

wherein the support portion is formed by a support plate defining a main extension plane;

wherein the support plate is adapted for being connected to the panel in a way that the main extension plane of the support plate is parallel to an extension plane of the panel;

wherein the support plate includes a base section, a first plate section provided with the first engagement portion, and a second plate section provided with the second engagement portion;

wherein at least one of the first plate section and the second plate section is spaced from the base section by the at least one opening or weak portion;

wherein the device includes a displacement structure adapted for effecting the displacement of the first engagement portion relative to the second engagement portion;

wherein the displacement structure includes a receptacle adapted to be at least partly widened when receiving a correspondingly shaped end portion of the leg; and wherein the at least one opening or weak portion forms a part of the receptacle so that the displacement of the first engagement portion relative to the second engagement portion is effected when the leg is received in the receptacle;

wherein the at least one opening or weak portion is located on opposite sides of at least one of the first engagement portion and the second engagement portion in a displacement direction for allowing the relative displacement.

2. The device according to claim 1, wherein the device is adapted for allowing relative displacement of the first engagement portion and the second engagement portion away from each other.

3. The device according to claim 1, wherein the device is adapted for allowing displacement of the first engagement portion relative to the second engagement portion while maintaining an outer peripheral shape of the device non-effected.

4. An arrangement for distancing a cabinet from a floor, the arrangement comprising:

a device according to claim 1; and a leg adapted to be attached to a panel of the cabinet via the device.

5. A device for attaching a leg to a panel of a cabinet, the device comprising:

a support portion;

a first engagement portion defining a first main extension;

a second engagement portion defining a second main extension;

wherein the first main extension and the second main extension are parallel to each other;

wherein the first engagement portion and the second engagement portion are connected to the support portion spaced from each other;

wherein each one of the first engagement portion and the second engagement portion includes a projection or recess that is adapted to be connected to a corresponding recess or projection in the panel;

wherein the device is adapted for allowing relative displacement of the first engagement portion and the second engagement portion;

at least one opening or weak portion located between the first engagement portion and the second engagement portion for allowing the relative displacement between the first engagement portion and the second engagement portion;

wherein the support portion is formed by a support plate defining a main extension plane;

wherein the support plate is adapted for being connected to the panel in a way that the main extension plane of the support plate is parallel to an extension plane of the panel;

wherein the support plate includes a base section, a first plate section provided with the first engagement portion, and a second plate section provided with the second engagement portion;

wherein at least one of the first plate section and the second plate section is spaced from the base section by the at least one opening or weak portion;

wherein the device includes a displacement structure adapted for effecting the displacement of the first engagement portion relative to the second engagement portion;

wherein the displacement structure includes a receptacle adapted to be at least partly widened when receiving a correspondingly shaped end portion of the leg;

wherein the at least one opening or weak portion forms a part of the receptacle so that the displacement of the first engagement portion relative to the second engagement portion is effected when the leg is received in the receptacle;

wherein the at least one opening or weak portion is formed by a slot which has an extension so that it surrounds at least one of the first engagement portion and the second engagement portion on three sides for allowing the relative displacement.

6. A device for attaching a leg to a panel of a cabinet, the device comprising:

a support portion;

a first engagement portion defining a first main extension;

a second engagement portion defining a second main extension;

wherein the first main extension and the second main extension are parallel to each other;

wherein the first engagement portion and the second engagement portion are connected to the support portion spaced from each other;

wherein each one of the first engagement portion and the second engagement portion includes a projection or recess that is adapted to be connected to a corresponding recess or projection in the panel;

wherein the device is adapted for allowing relative displacement of the first engagement portion and the second engagement portion;

at least one opening or weak portion located between the first engagement portion and the second engagement portion for allowing the relative displacement between the first engagement portion and the second engagement portion;

wherein the support portion is formed by a support plate defining a main extension plane;

wherein the support plate is adapted for being connected to the panel in a way that the main extension plane of the support plate is parallel to an extension plane of the panel;

wherein the support plate includes a base section, a first plate section provided with the first engagement portion, and a second plate section provided with the second engagement portion;

wherein at least one of the first plate section and the second plate section is spaced from the base section by the at least one opening or weak portion;

wherein the device includes a displacement structure adapted for effecting the displacement of the first engagement portion relative to the second engagement portion;

wherein the displacement structure includes a receptacle adapted to be at least partly widened when receiving a correspondingly shaped end portion of the leg;

wherein the at least one opening or weak portion forms a part of the receptacle so that the displacement of the first engagement portion relative to the second engagement portion is effected when the leg is received in the receptacle;

wherein at least one of the first plate section and the second plate section is elastically connected to the base section for allowing an elastic movement in parallel with the main extension plane of the support plate.

7. A device for attaching a leg to a panel of a cabinet, the device comprising:

a support portion;

a first engagement portion defining a first main extension;

a second engagement portion defining a second main extension;

wherein the first main extension and the second main extension are parallel to each other;

wherein the first engagement portion and the second engagement portion are connected to the support portion spaced from each other;

wherein each one of the first engagement portion and the second engagement portion includes a projection or recess that is adapted to be connected to a corresponding recess or projection in the panel;

wherein the device is adapted for allowing relative displacement of the first engagement portion and the second engagement portion;

at least one opening or weak portion located between the first engagement portion and the second engagement portion for allowing the relative displacement between the first engagement portion and the second engagement portion;

wherein the support portion is formed by a support plate defining a main extension plane;

wherein the support plate is adapted for being connected to the panel in a way that the main extension plane of the support plate is parallel to an extension plane of the panel;

wherein the support plate includes a base section, a first plate section provided with the first engagement portion, and a second plate section provided with the second engagement portion;

wherein at least one of the first plate section and the second plate section is spaced from the base section by the at least one opening or weak portion;

wherein the device includes a displacement structure adapted for effecting the displacement of the first engagement portion relative to the second engagement portion;

wherein the displacement structure includes a receptacle adapted to be at least partly widened when receiving a correspondingly shaped end portion of the leg;

wherein the at least one opening or weak portion forms a part of the receptacle so that the displacement of the first engagement portion relative to the second engagement portion is effected when the leg is received in the receptacle;

wherein the first engagement portion and the second engagement portion are arranged adjacent opposite ends of the support portion; and wherein the displacement structure is located in a central area of the support portion.

8. An arrangement for distancing a cabinet from a floor, the arrangement comprising:

a leg adapted to be attached to a panel of the cabinet;

a device for attaching the leg to the panel of the cabinet, the device having a support portion;

a first engagement portion defining a first main extension;

a second engagement portion defining a second main extension;

wherein the first main extension and the second main extension are parallel to each other;

wherein the first engagement portion and the second engagement portion are connected to the support portion spaced from each other;

wherein each one of the first engagement portion and the second engagement portion includes a projection or recess that is adapted to be connected to a corresponding recess or projection in the panel;

wherein the device is adapted for allowing relative displacement of the first engagement portion and the second engagement portion;

at least one opening or weak portion located between the first engagement portion and the second engagement portion for allowing the relative displacement between the first engagement portion and the second engagement portion;

wherein the support portion is formed by a support plate defining a main extension plane;

wherein the support plate is adapted for being connected to the panel in a way that the main extension plane of the support plate is parallel to an extension plane of the panel;

wherein the support plate includes a base section, a first plate section provided with the first engagement portion, and a second plate section provided with the second engagement portion;

wherein at least one of the first plate section and the second plate section is spaced from the base section by the at least one opening or weak portion;

wherein the device includes a displacement structure adapted for effecting the displacement of the first engagement portion relative to the second engagement portion;

wherein the displacement structure includes a receptacle adapted to be at least partly widened when receiving a correspondingly shaped end portion of the leg;

wherein the at least one opening or weak portion forms a part of the receptacle so that the displacement of the first engagement portion relative to the second engagement portion is effected when the leg is received in the receptacle;

wherein an upper portion of the leg and/or a wall portion defining the receptacle of the displacement structure has a tapering shape for subjecting the wall portion to an increasing force during attachment in order to gradually effect the displacement.

9. A cabinet comprising:

a leg adapted to be attached to a panel of the cabinet;

a device for attaching the leg to the panel of the cabinet, the device having a support portion;

a first engagement portion defining a first main extension;

a second engagement portion defining a second main extension;

wherein the first main extension and the second main extension are parallel to each other;

wherein the first engagement portion and the second engagement portion are connected to the support portion spaced from each other;

wherein each one of the first engagement portion and the second engagement portion includes a projection or recess that is adapted to be connected to a corresponding recess or projection in the panel;

wherein the device is adapted for allowing relative displacement of the first engagement portion and the second engagement portion;

at least one opening or weak portion located between the first engagement portion and the second engagement portion for allowing the relative displacement between the first engagement portion and the second engagement portion;

wherein the support portion is formed by a support plate defining a main extension plane;

wherein the support plate is adapted for being connected to the panel in a way that the main extension plane of the support plate is parallel to an extension plane of the panel;

wherein the support plate includes a base section, a first plate section provided with the first engagement portion, and a second plate section provided with the second engagement portion;

wherein at least one of the first plate section and the second plate section is spaced from the base section by the at least one opening or weak portion;

wherein the device includes a displacement structure adapted for effecting the displacement of the first engagement portion relative to the second engagement portion;

wherein the displacement structure includes a receptacle adapted to be at least partly widened when receiving a correspondingly shaped end portion of the leg;

wherein the at least one opening or weak portion forms a part of the receptacle so that the displacement of the first engagement portion relative to the second engagement portion is effected when the leg is received in the receptacle;

wherein the panel is provided with at least two engagement portions arranged spaced from each other and extending perpendicularly to a main extension plane of the panel;

wherein the first engagement portion and the second engagement portion of the device are adapted for engagement with a respective one of the two engagement portions of the panel; and wherein the device is adapted so that the displacement of the first engagement portion relative to the second engagement portion is effected when the device is attached to the panel so that contact surfaces of the first engagement portion and the second engagement portion are urged against corresponding contact surfaces of the engagement portions of the panel.

* * * * *